US009486019B2

(12) United States Patent
Kitowski

(10) Patent No.: US 9,486,019 B2
(45) Date of Patent: Nov. 8, 2016

(54) PROTECTIVE UNDERGARMENT

(71) Applicant: Patrick Kitowski, Arvada, CO (US)

(72) Inventor: Patrick Kitowski, Arvada, CO (US)

( * ) Notice: Subject to any disclaimer, the term of this patent is extended or adjusted under 35 U.S.C. 154(b) by 240 days.

(21) Appl. No.: 14/057,292

(22) Filed: Oct. 18, 2013

(65) Prior Publication Data

US 2014/0068847 A1 Mar. 13, 2014

Related U.S. Application Data

(63) Continuation of application No. 14/019,574, filed on Sep. 6, 2013, now abandoned.

(60) Provisional application No. 61/697,941, filed on Sep. 7, 2012.

(51) Int. Cl.

| | |
|---|---|
| ***A41D 13/015*** | (2006.01) |
| ***A62B 17/00*** | (2006.01) |
| ***F41H 1/00*** | (2006.01) |
| ***G21F 3/02*** | (2006.01) |
| ***A41D 13/005*** | (2006.01) |
| ***A41B 9/12*** | (2006.01) |
| ***A41D 13/00*** | (2006.01) |

(52) U.S. Cl.

CPC ..... *A41D 13/005* (2013.01); *A41B 9/12* (2013.01); *A41D 13/0015* (2013.01); *A41B 2400/60* (2013.01)

(58) Field of Classification Search

CPC ..... A41D 13/0015; A41D 13/0156; A41B 9/12; A41B 2400/60

USPC ..... 2/455, 465, 69, 109, 113

See application file for complete search history.

(56) References Cited

U.S. PATENT DOCUMENTS

| | | | | |
|---|---|---|---|---|
| 7,100,216 | B2 * | 9/2006 | Matechen | A41D 13/0156 2/455 |
| 7,650,648 | B2 * | 1/2010 | Roberts | A41B 9/00 2/195.8 |
| 8,059,000 | B2 * | 11/2011 | Ishikawa | A41D 13/018 2/455 |
| 2010/0319097 | A1 * | 12/2010 | Turner | A41D 13/0587 2/22 |
| 2010/0326192 | A1 * | 12/2010 | Petelenz | F41H 1/02 73/579 |
| 2011/0203347 | A1 * | 8/2011 | Hower | G01D 21/00 73/12.01 |
| 2011/0251802 | A1 * | 10/2011 | Song | A63B 69/004 702/41 |
| 2012/0084896 | A1 * | 4/2012 | Wyner | A63B 71/08 2/16 |

* cited by examiner

*Primary Examiner* — Lisa Caputo
*Assistant Examiner* — Roger Hernandez-Prewit
(74) *Attorney, Agent, or Firm* — Scott L. Terrell, P.C.; Scott L. Terrell

(57) ABSTRACT

An protective athletic undergarment is provided. The undergarment has a moisture-wicking elastic fabric base layer configured to fit flexibly and snugly against the body of the wearer. A padding assembly has an inner polymer cushion with an interior surface attached to an outer surface of the base layer, and a rigid outer shell configured in a predetermined three-dimensional complimentary contour relative to an outer surface shape of an anatomical feature. The undergarment may include a system for sports performance monitoring of an impact event delivered by another participant or the object of a sporting event.

14 Claims, 8 Drawing Sheets

PROTECTIVE UNDERGARMENT

CROSS REFERENCE TO RELATED APPLICATIONS

Pursuant to 35 U.S.C. 120, the Applicant claims the benefit of U.S. Ser. No. 14/019,574 filed Sep. 6, 2013, pursuant to 35 U.S.C. 111(a), which claims the benefit, pursuant to 35 U.S.C. 119(e), of U.S. Ser. No. 61/697,941, filed, pursuant to 35 U.S.C. 111(b), on Sep. 7, 2012.

STATEMENT OF FEDERALLY SPONSORED RESEARCH

None.

BACKGROUND OF THE INVENTION

1. Field of the Invention

The present invention relates to protective athletic apparel. In particular, it relates to a protective athletic undergarment. More particularly, it relates to an article of padded moisture-wicking athletic underwear and system for sport performance monitoring of a force of traumatic impact.

2. Description of the Related Art

Padded protective athletic clothing is a well known solution to the problem of mitigating injuries sustained by participants in an athletic event. Such clothing typically consists of padding elements secured in pockets, or sewn into the outerwear fabric of athletic clothing, in order to protect an athlete from blows experienced by the wearer and delivered by other participants, or the objects of the event.

One such example is disclosed in U.S. Pat. No. 4,866,789, to Dorm, for a protective body suit formed of a stretchable material which defines a pair of leg openings, a pair of arm openings, and a neck opening. The body suit is sized and shaped to conform to the body of the user. A pair of side pads is secured to the body suit, between the arm openings and the aligned leg openings. A pair of resilient shoulder pads is secured to the body suit between the neck opening and the respective ones of the arm openings to protect the shoulders of the user. The pads are held securely in place against the body of the user during athletic activity with shoulder straps secured over the shoulders with hook and loop fasteners.

Other approaches to providing solutions to the problem of protecting an athlete from injuries associated with traumatic impact are illustrated in U.S. Pat. No. 4,100,620 to Pecoraro (a impact abosorbing vest), U.S. Pat. No. 4,185,327 to Markve (a air-cell coverall suit), U.S. Pat. No. 4,195,362 to Rolando (a impact-resistant ski jacket), and U.S. Pat. No. 3,135,961 to Roderick (a free-hanging, padded T-shirt).

While the foregoing articles of protective clothing offer some utility, what is needed is an improved article of protective underwear designed to protect a participant from a blunt force of traumatic impact, but which is flexible, conforming, light-weight, and moisture-wicking. Moreover, it is desirable to provide an article of padded moisture-wicking athletic underwear with and integrated system for sport performance monitoring of a g force of traumatic impact. The present invention satisfies these needs.

BRIEF SUMMARY OF THE INVENTION

It is therefore an object of the present invention to provide an article of protective padded athletic underwear designed to protect a participant from a blunt force of traumatic impact.

It is another object of the present invention to provide an article of protective padded athletic underwear designed to protect a participant from a blunt force of traumatic impact, which is flexible, conforming, light-weight, and moisture-wicking.

It is yet another object of the present invention to provide an article of protective padded athletic underwear designed to protect a participant from a blunt force of traumatic impact, and a system for sport performance monitoring of a force of traumatic impact.

To overcome the problems of the prior art and in accordance with the purpose of the invention, as embodied and broadly described herein, briefly a protective athletic undergarment is provided. The undergarment has a moisture-wicking elastic fabric base layer configured to fit flexibly and snugly against the body of the wearer. A padding assembly has an inner polymer cushion with an interior surface attached to an outer surface of the base layer, and a rigid outer shell configured in a predetermined three-dimensional complimentary contour relative to an outer surface shape of an anatomical feature. The undergarment may include as system for sports performance monitoring of an impact delivered from another participant or the object of a sporting event.

Additional advantages of the present invention will be set forth in part in the description that follows and in part will be obvious from that description or can be learned from practice of the invention. The advantages of the invention can be realized and obtained by the inventions particularly pointed out in the appended claims.

BRIEF DESCRIPTION OF THE SEVERAL VIEWS OF THE DRAWINGS

The accompanying drawings, which are incorporated in and which constitute a part of the specification illustrate at least one embodiment of the invention and, together with the description, explain the principles of the invention.

DETAILED DESCRIPTION OF THE INVENTION

Unless specifically defined otherwise, all technical or scientific terms used herein have the same meaning as commonly understood by one of ordinary skill in the art to which this invention belongs.

For the purposes of the following description, the phrase "blunt force of traumatic impact(s)" refers to those forces which are experienced by a person, including impacts, jolts or impacts resulting from normal athletic activities such as running, jumping, dropping to the ground, and making contact with a fellow participant or the object of an event such as balls, sticks, rails, boards, and surfaces, such as asphalt and ice. Examples of such athletic events include the sports of football, baseball, basketball, and hockey, but the present invention is also useful to protect persons engaged in activities such as bicycling, skating, snow boarding, motorcycle riding, and automobile racing.

The term "undergarment" means clothes that are worn under other clothes, pads, jerseys, sweaters, and pants, primarily intended for wear directly next to the skin to conform snugly and flexibly, in shape, to the torso, pelvis, and limbs of a participant. As used herein the term "undergarment" also means those articles of clothing often referred to undershirts, briefs, boxers and underpants.

Although any of the methods and materials similar or equivalent to those described herein can be used in the practice or testing of the present invention, the preferred methods and materials are now described. Reference will now be made in detail to the presently preferred embodiments of the invention, examples of which are illustrated in the accompanying drawings, wherein like numerals represent like features of the invention.

Figure 1:
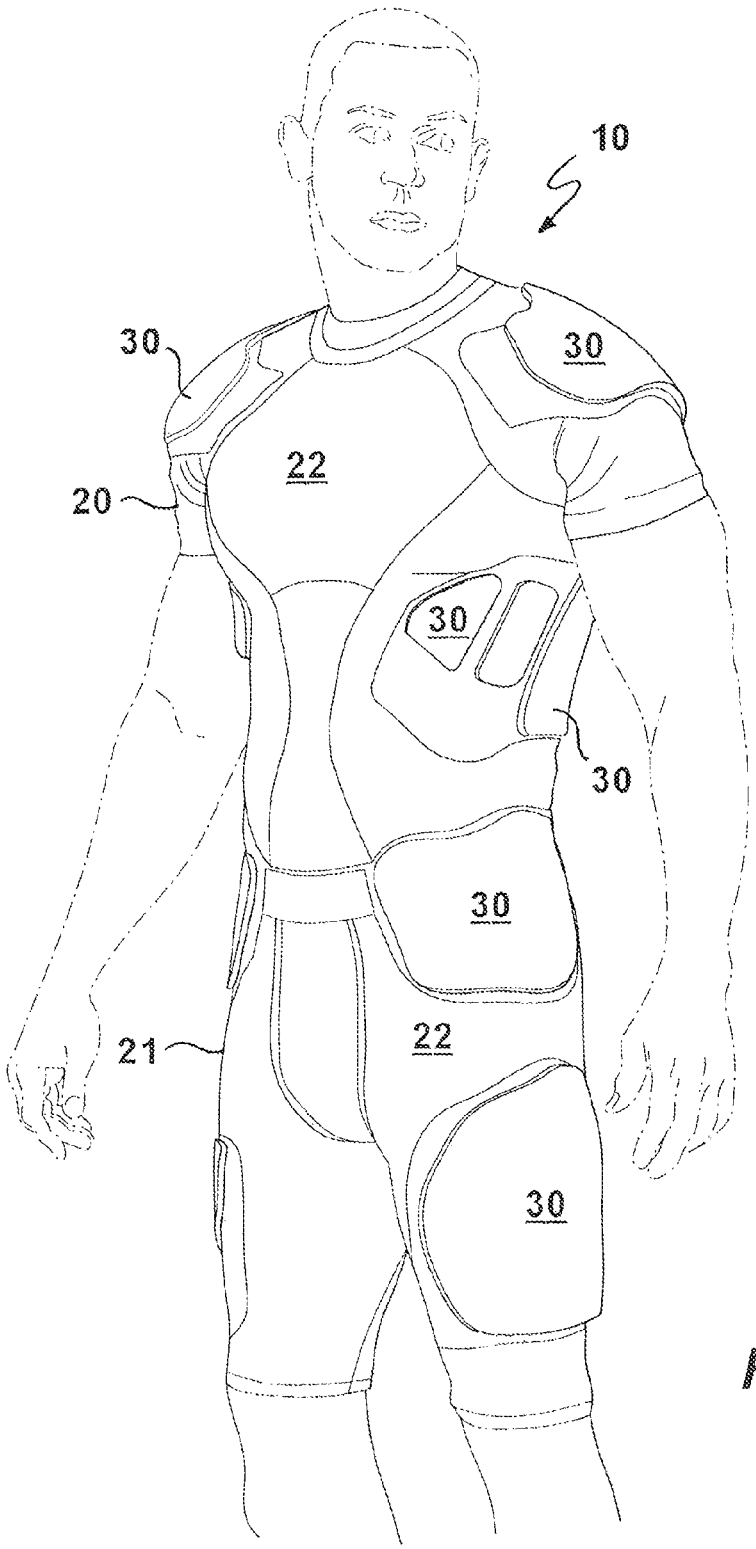
FIG. 1 is an isometric view showing a general embodiment of the present invention where the padding assembly elements are single assemblies molded in a three-dimensional contour which is complimentary to an anatomical surface of the wearer.

FIG. 1 illustrates the general embodiment of the present invent. Here, the present invention can include a participant 10 wearing both an under shirt 20 and an underpants 21 made of a moisture-wicking elastic fabric base layer 22. One or more of the padding assembly elements 30 are attached to an exterior surface of the base layer 22.

The protective undergarment may, but need not, include both an undershirt 20 and underpants 21. Here, the moisture wicking elastic stretch material is further adapted to define a pair of leg openings and a waist opening. The underpants 21 are conforming in size and shape to fit snugly to the waist, buttocks, and thighs of the wearer. The undergarment is preferably designed in a pattern which allows for a pullover-the-body type construction of moisture-wicking fabric. Suitable fabrics are preferably based upon plaited micro fibers 23. The outer surfaces of these fabrics are preferably chemically treated with either one of a hydrophilic (water-loving) chemical, that wicks perspiration away through the fabric to the outer surface, and/or an antimicrobial agent. Examples of such fabrics, which are suitable for use, include those acrylic fabrics, derived from polyacrylonitrile, where one desires to provide a soft, washable, colorfast, synthetic fiber base layer. Other suitable fibers include polyesters, such as COMFORTREL®, a chemically treated polyester base-layer fabric made by Wellman, Inc., COOLMAX™, by Invista, a hydrophobic tetra-channel polyester which includes fiber cross sections that produce a strong wicking action, or SUPPLEX®, also by Invista, where one desires the base layer to consist of a cotton based active-ware fabric.

Figure 2:
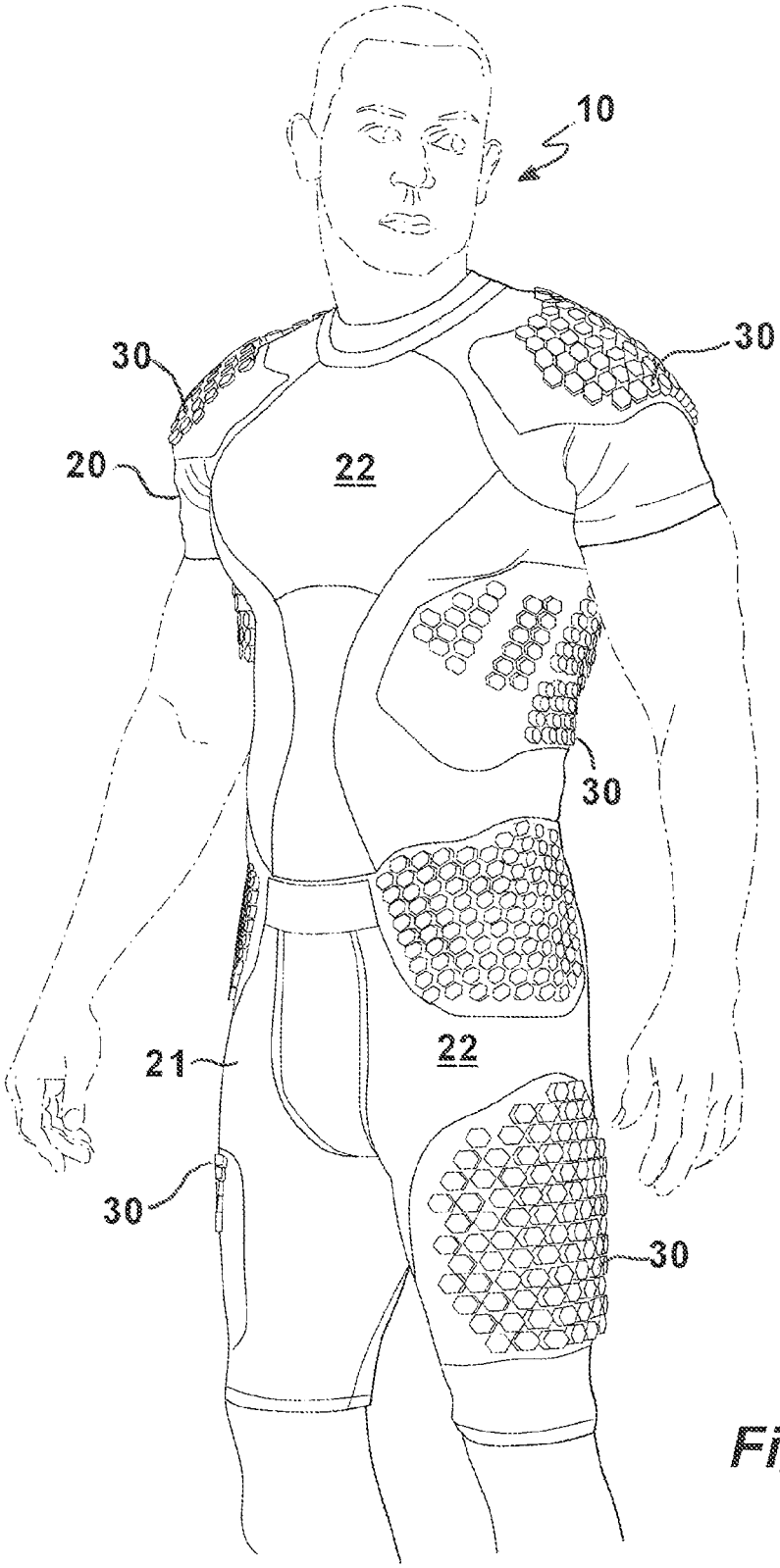
FIG. 2 is an isometric view showing a presently preferred embodiment of the invention where the three-dimensional contour is a tiling of faceted faces of the outer shells of an array of padding assembly elements with a spacing therebetween.
Figures 3, 3A:
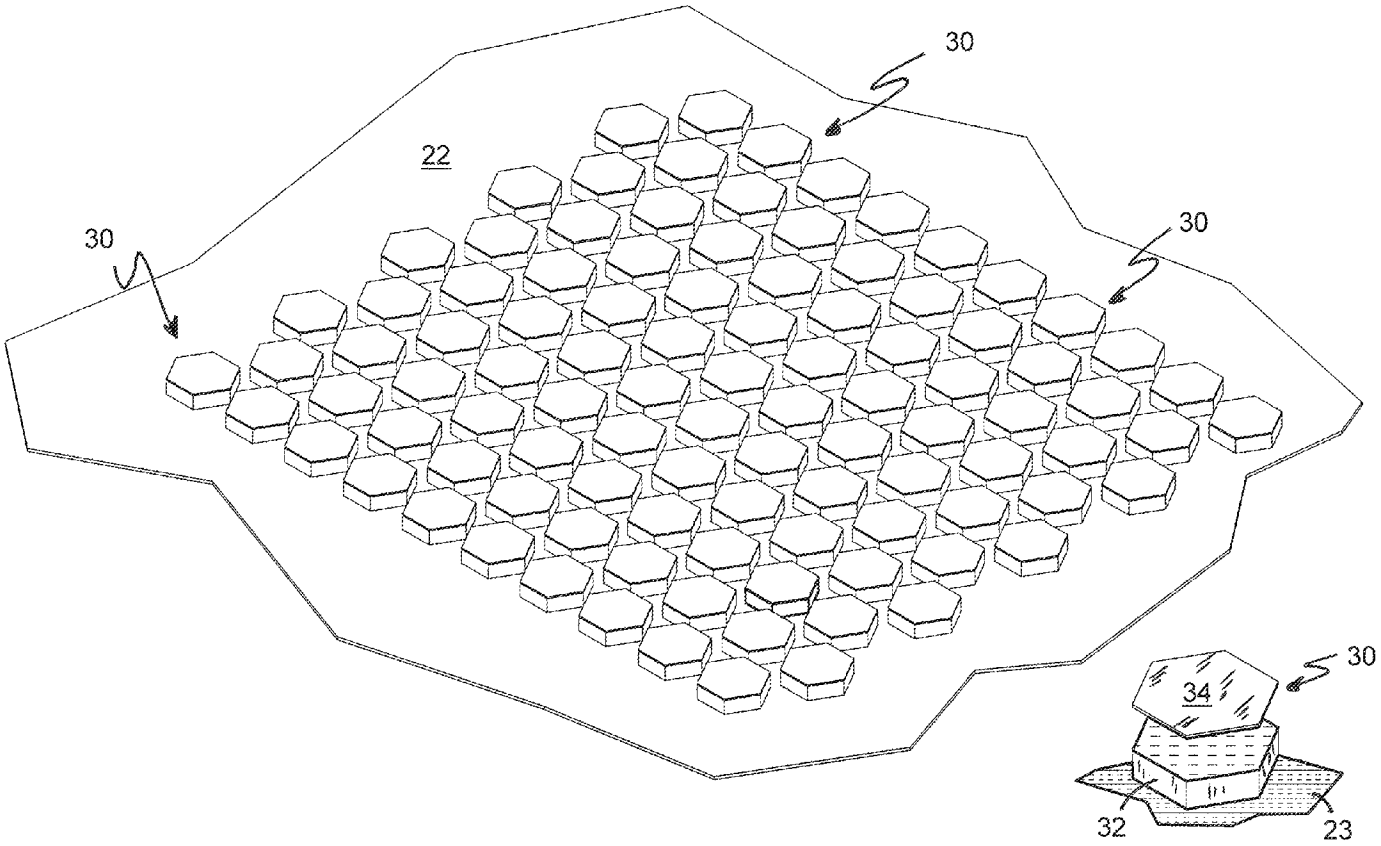
FIG. 3 is an isometric view of the presently preferred embodiment of the invention showing the three-dimensional contour being a tiling of faceted faces of the outer shells of an array of padding assembly elements with a spacing therebetween.
FIG. 3*a* is an exploded isometric view of the padding assembly element showing the component parts to include the thin outer shell supported on the inner polymer cushion.

FIGS. 2 and 3 illustrate the presently preferred embodiment. There the padding assembly elements 30 are integrated or attached to an outer surface of the base layer 22, and are being sized and positioned in an spaced apart array so that the padding assembly elements 30 form a flexible three-dimensional contour which is complementary to an exterior surface of an anatomical feature of the participant 10, to be protected. In FIG. 3*a*, it is readily observed that each of the padding assembly elements 30, include an inner polymer cushion 32, attached the base layer 22, and a light-weight thin outer shell 34 adhered to and covering the cushion 32. The outer shell 34, of the padding assembly 30, is of a sufficient rigidity to deflect a blow delivered from a blunt force of traumatic impact, and the cushion 32 is sufficiently capable of absorbing the impact. The outer shell 34 is preferably constructed from a thin carbon fiber sheet, but may also be constructed of any semi-rigid polymer or glass fiber, which has gained wide acceptance in the industry, as being a suitable composition for deflecting an impact. In the presently preferred embodiment, the functional thickness of the outer shell 34 is in a range of 3-8 mm so that the sheet retains a semi-flexible function, while being light-weight and of sufficient rigidity. The polymer cushion 32 is preferably a foam cushion. Suitable foam materials, for use with the present invention, include those compression molded foams of Polyurethane "Viscoelastic" (PU), Polyethylene (PE) or Ethylene-Vinyl Acetate (EVA). Both the composition and the relative densities of the foam cushion material selected can also be inter-mixed and matched depending upon intended use. Thickness of the foam cushion 34 is desirably in a range of 0.5-15 mm to functionally absorb the impact.

Figure 4:
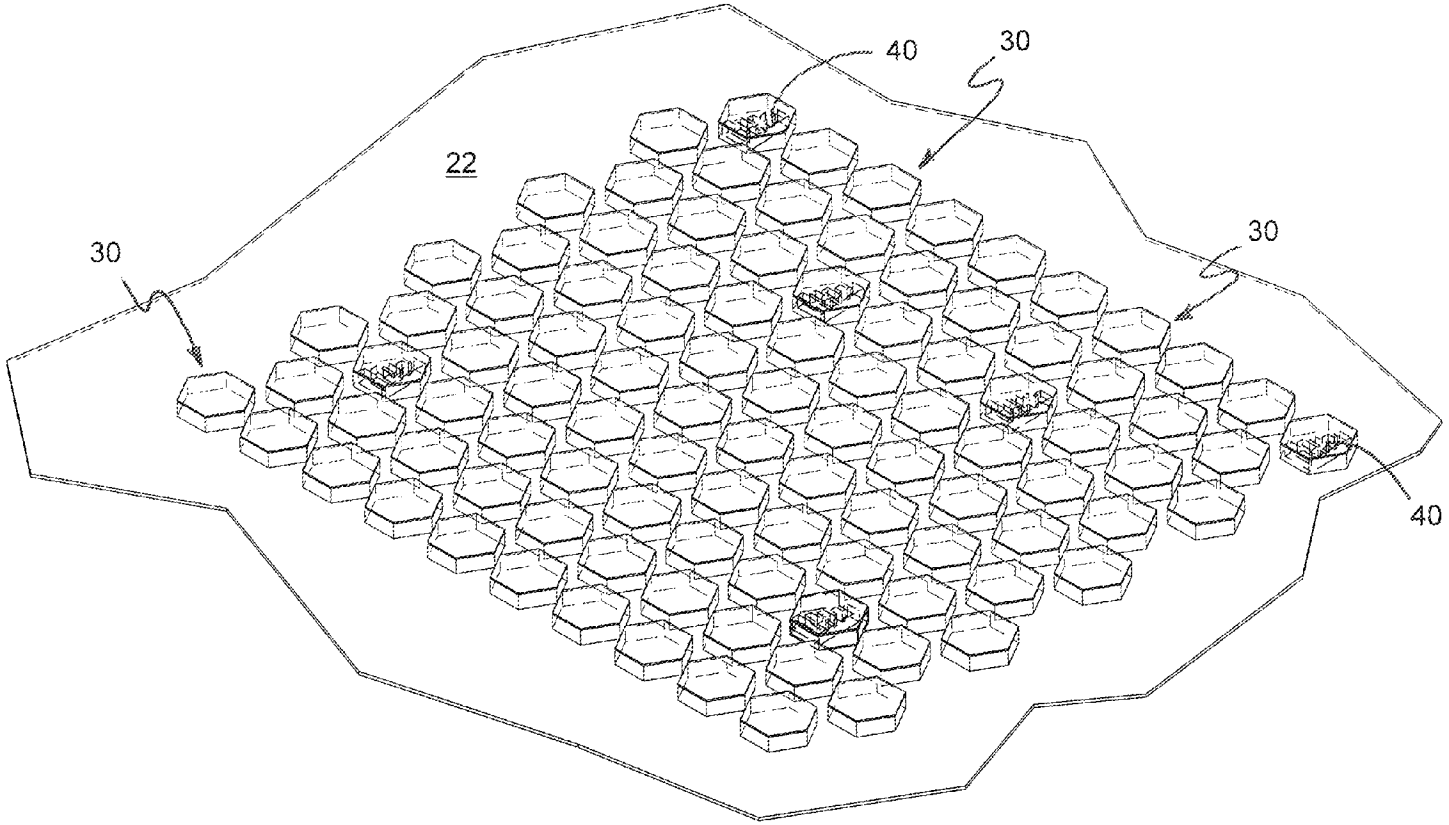
FIG. 4 is an isometric hidden-line view of the presently preferred embodiment shown in FIG. 3 with some of the padding assembly elements including electromechanical self-powered cantilever beam impact sensors housed in the cushion of the padding assembly for monitoring sports performance of an impact.

Referring now to FIGS. 2 and 4, conceptually it is desirable to configure the padding assembly elements 30 in a tiling array with a spacing therebetween. The array is arranged with one or more of the impact sensor elements 40 positioned about differing anatomical surfaces, of the participant 10, for sensing differing degrees of impact on one or more orthogonal axes. The flexible three-dimensional contour is preferably configured as a tiling of padding assembly elements 30 which are smaller and uniform in size and shape. With this embodiment, the outer shells 34 of the padding assembly elements 30 are substantially planar to provide a flexible array of substantially planar facets with a spaced apart relationship interposed therebetween. The spaced apart relationship is sufficiently dimensioned, as a functional relationship to the depth and width of the individual padding assembly elements 30, so that each of the individual padding elements 30 are capable of interposition on a dynamic X, Y and Z axes of rotation. This interposition allows the padding elements 30 to dynamically conform in three-dimensional shape to be consistent with any dynamic change in the outer surface shape of an anatomical surface of the participant while in motion. Each of the padding assembly elements 30, which make up the tiling array, are preferably configured in an elliptical or polygonal shaped assembly, having a length and width sized in a range of 2-4 cm×2-3 cm, with a cushion 32 depth in a range of between 0.5-15 mm.

Figure 5:
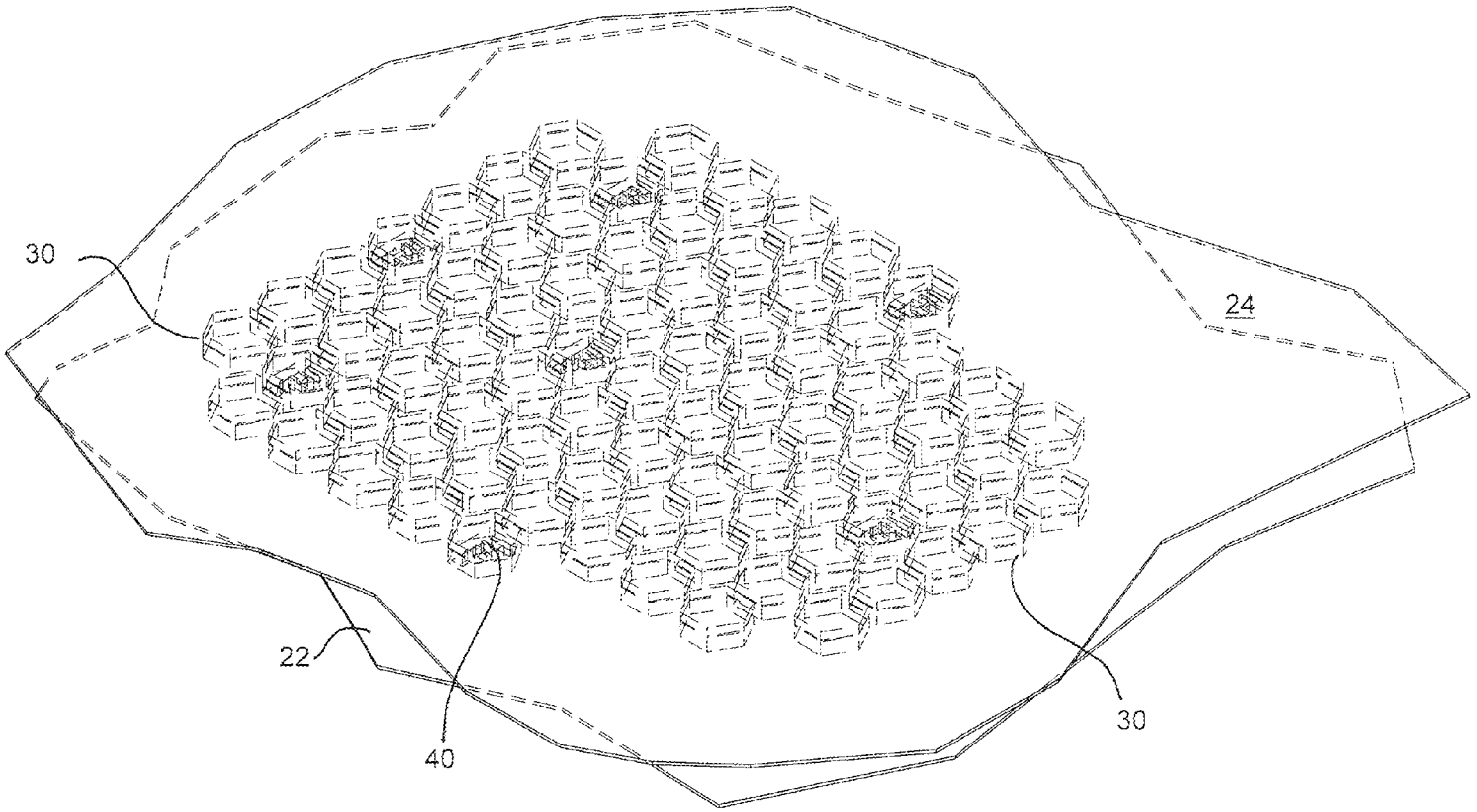
FIG. 5 is an isometric view of the embodiment shown in FIG. 4 which illustrates an embodiment where the padding assembly elements are sandwiched between the base layer and an outer fabric layer.
Figure 6:
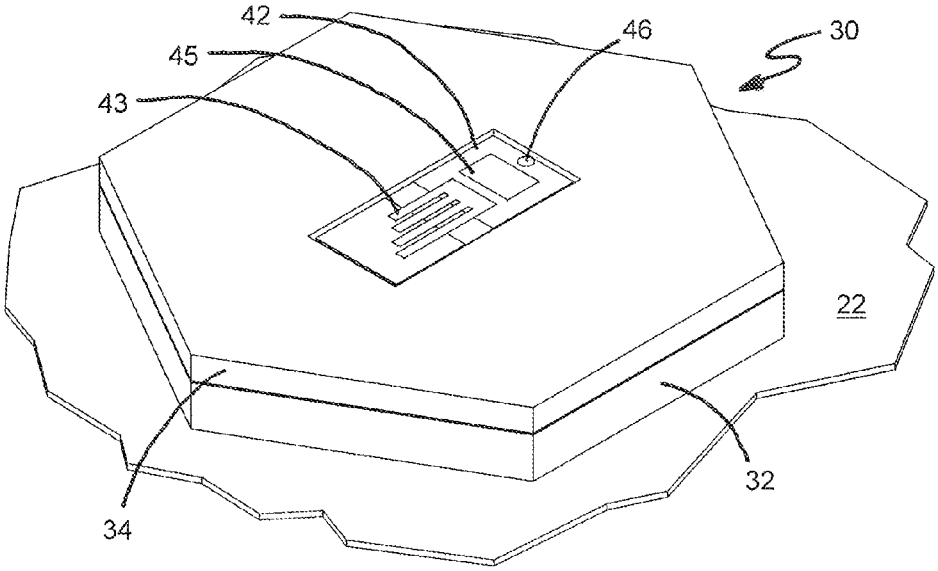
FIG. 6 is an isometric view showing an embodiment where one of the padding assembly elements includes the electromechanical self-powered cantilever beam impact sensor, monitoring system IC Chip, and battery housed in the out shell.
Figure 7:
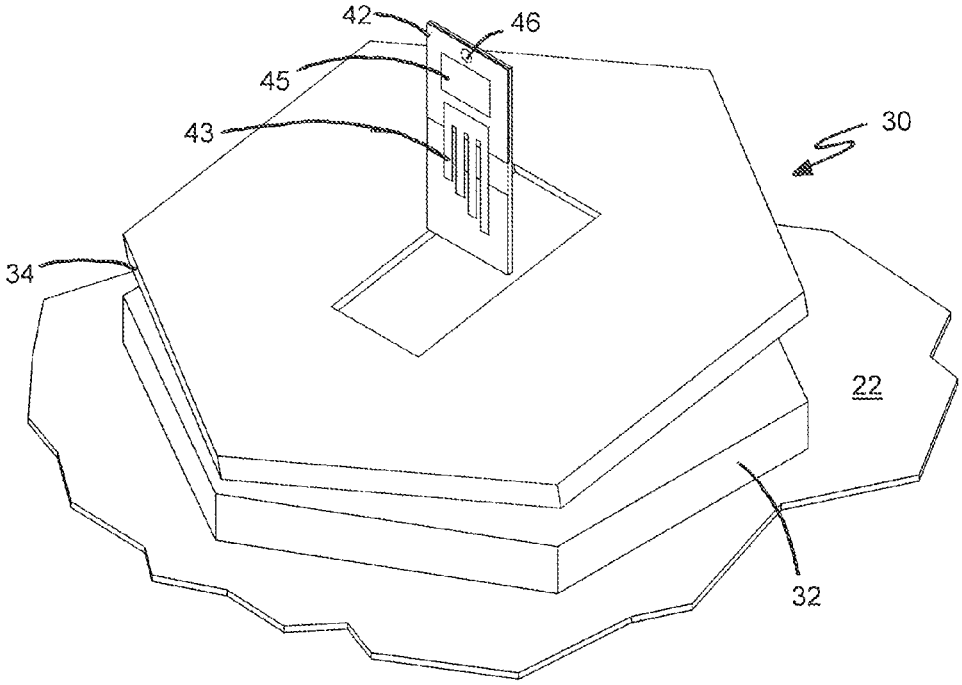
FIG. 7 is an exploded isometric view of the embodiment illustrated in FIG. 6 showing the electromechanical self-powered cantilever beam impact sensor housing.
Figure 8:
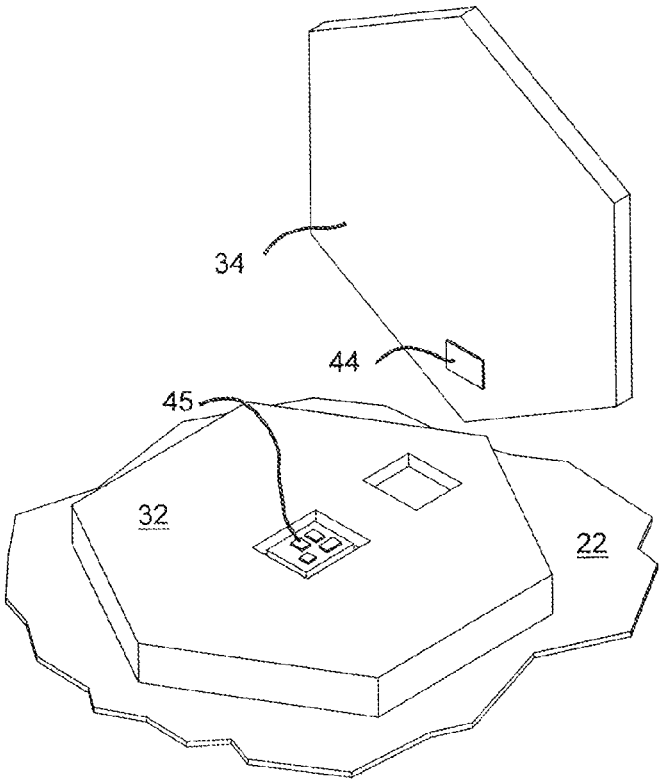
FIG. 8 is an isometric view showing a presently preferred embodiment of the present invention where the sports performance monitoring system is an integrated microelectromechanical sensors ("MEMS") attached to an interior surface of the outer shell of the padding assembly, one or more elements of the sports performance monitoring system all on a single monolithic integrated circuit ("IC") chip housed in the cushion portion of the padding assembly, and a battery housed in the outer surface of the outer shell for use in telemetry applications.
Figure 9:
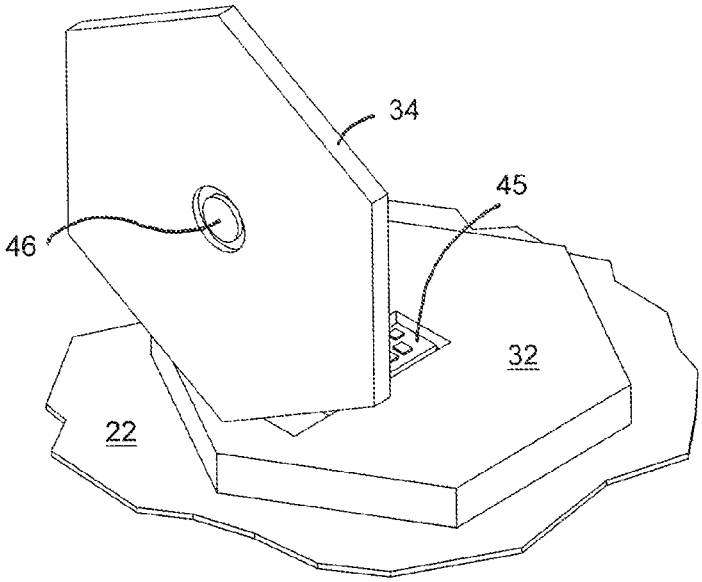
FIG. 9 is an isometric view of the embodiment shown in FIG. 9 illustrating the top surface battery and battery housing in the exterior surface of the outer shell.

Referring now to FIG. 5, where the three-dimensional contour is provided as a faceted array of outer shells of the padding assembly elements 30, it is also desirable to include an outer layer 24 of fabric covering the faceted array of outer shells 34, of padding assembly elements 30, with the outer margins of the outer layer 24 being attached to the base layer 22. In the presently preferred embodiment, the outer layer 24 is a fabric mesh material.

One or more of the padding assembly elements 30 may, but need not, include at least one impact sensor 40, and a system, for sports performance monitoring of the impact. The impact sensor 40 detects the impact, and the system quantifies, and records a magnitude, duration, and/or direction of an impact. Impact sensors 40 which are suitable for the practice of the present invention may, but need not, be self-powered. Impact recorders suitable for use with the present invention include piezoelectric sensors 42 which can be coupled to an array of tuned cantilever beams 43 of ascending length. Depending upon the intended application, the impact sensors 40 can also be integrated microelectromechanical sensors ("MEMS") 44, with one or more elements of the sports performance monitoring system all on a single monolithic integrated circuit ("IC") chip 45. Depending upon intended use, the IC sports performance monitoring system can include latchable memories, having first-in-first-out ("IFIO") functionality to capture and retain impact related data, electronic circuits, microcontrollers, analog-to-digital/digital-to-analog converters, programmable digital signal processors ("DSP"), timers, filters, analog and digital inputs and outputs, and a battery 46 so that the system is capable of sensing, recording, converting, processing, outputting, and transmitting impact telemetry related data. Some or all of these elements of the system are housed, or integrated, in one or more of the padding assembly cushion 32 and/or outer shell 34.

Piezoelectric thin film impact sensors 42 are well known. Such sensors may be manufactured using impact sensing elements, such as a piezoelectric material sandwiched between two electrode layers. The electrode layers can be platinum and the piezoelectric material can be PZT, $BaTiO_3$, ZnO, MN, or PbNiNbO. Other similar or compatible materials for the electrodes and piezoelectric material can also be considered to fall within the scope of the present invention. The piezoelectric materials are typically deposited on the alloy by RF reactive magnetron sputtering. One example of an electromechanical impact recorder, capable of for modification for any intended event is to provide an electromechanical cantilever beam self-powered piezoelectric shock sensor disclosed in U.S. Pat. No. 8,191,421, to Petelenz, et. al, This disclosure is incorporated by reference as though fully set forth herein. Here, the combination of a self-power piezoelectric sensor 42 coupled to an array of ascending length cantilever beam resonators 43 provides a tunable resonate response, with an inherent predetermined threshold interrupt value, to enable the sports performance impact monitoring, in a predetermined range, of those g forces which are characteristically encountered by a participant 10 engaged in any given event. This example is particularly suitable for use in monitoring those events which are characterized by a random, high magnitude, short duration degree of impacts, with an event-specific threshold resonance trigger that does not require external power to detect and record the magnitude of the impact event.

In another example, the presently preferred embodiment includes the use of integrated microelectromechanical MEMS semiconductor technology which combines the microelectromechanical accelerometer structures 44 and electrical circuits on a single silicon chip. The silicon chip is integrated within, or attached to, a padding assembly element. The integrated MEMS accelerometers 44 may sense acceleration on one, two, or even three axes, and provide either analog or digital outputs. Depending upon intended use, the accelerometer 44 may offer different ranges of detection, from several g to tens of g. Digital versions can be also be configured with multiple interrupt modes. Again, dependent upon intended use, a wide variety of integrated microelectromechanical MEMS sensors are suitable for use with the present invention including those manufactured under the Mark iMEMS®, owned by Analog Devices, Inc., of Norwood, Mass., USA.

It is also within the scope of the present invention embodiments where the integrated MEMS accelerometers 44 is a 3-axis microelectromechanical accelerometer structure attached to the padding assembly 30, 30 where one desires to detect changes in impact which are relative to body position of a participant, by tracking acceleration changes in three orthogonal directions. 3-axis MEMS accelerometers are also available from Analog Devices, Inc. in various configurations. For example, 3-axis devices can includes a selectable ±2-g, ±4-g, ±8-g, or ±16-g measurement range; resolution of up to 13 bits; fixed 4-mg/LSB sensitivity; a tiny 3-mm×5-mm×1-mm package; ultralow power consumption (25 μA to 130 μA); standard I2C∃ and SPI serial digital interfacing; and 32-level FIFO storage. A variety of built-in features may, but need not, include motion-status detection and flexible interrupts. With this system, the impact data is continuously analyzed algorithmically to determine whether, using the impact date relative to the motion and body position of the participant 10, the participant 10 is subject to impact, the maximum or absolute force of impact, impact duration, and location of impact, and, with a wireless transmitter, issue a status alert.

With another example, where the three-dimensional contour of the padding assembly 30 consists of a dynamic tiling array of smaller uniform padding assembly elements 30, it may be desirable to integrate, within the cushion 32 and/or outer shell 34 of the padding assembly 30, an arrangement of integrated single-axis high-g, and low-g MEMS accelerometers 44 about predetermined positions of the exterior anatomy of a participant 10 to monitor impacts received in differing orthogonal directions. Moreover, at least some of the single-axis integrated accelerometers 44 are desirably configured in an analog sensor platform which allows the user to program the integrated MEMS device with analog out so that one is capable of outputting the entire window of impact related information in real time.

Figure 10:
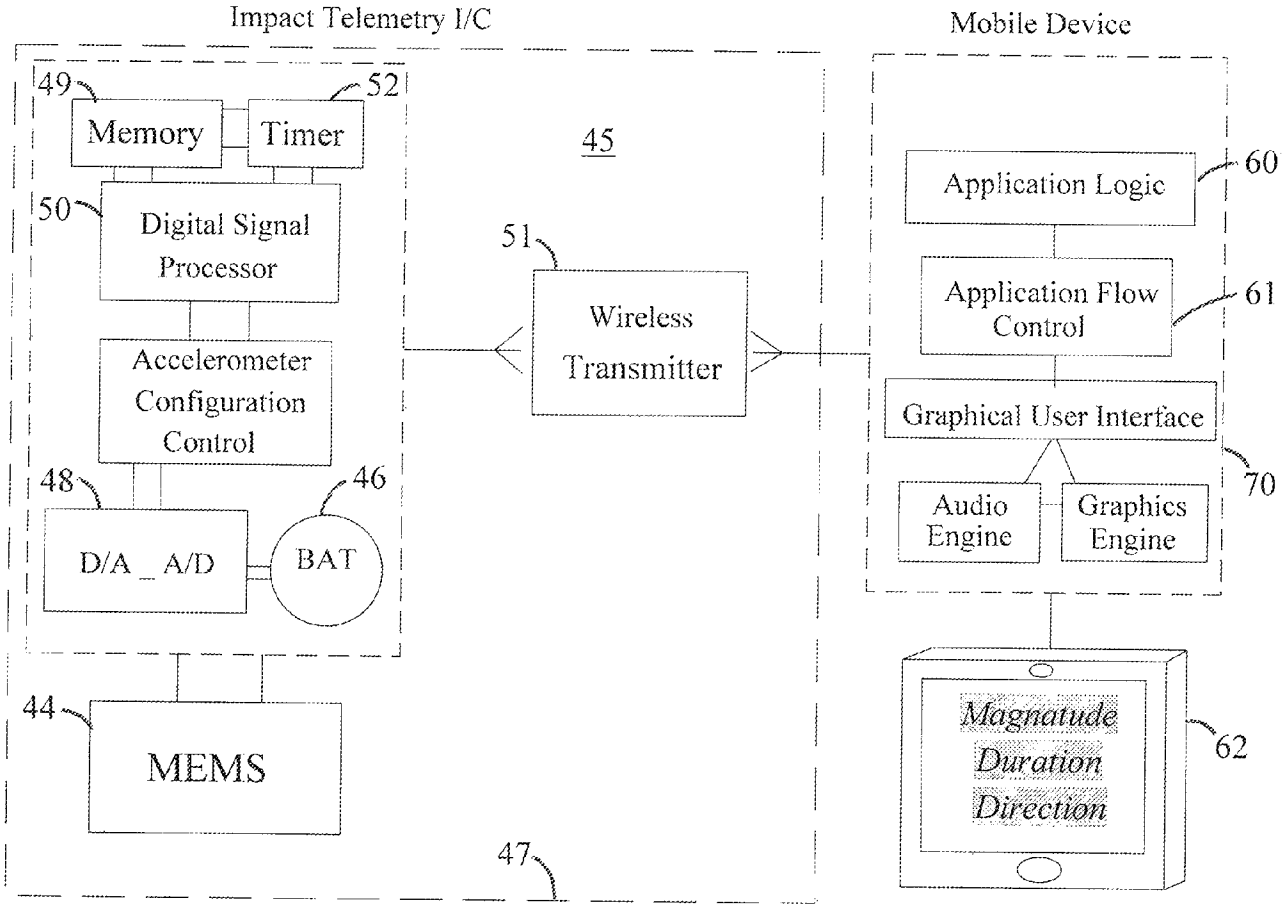
FIG. 10 is a diagram showing the MEMS impact sensor circuitry component of the sports performance monitoring system with wireless transmission to the mobile device and application algorithm for determining and displaying a calculated parametric impact.

Referring now to FIG. 10, in yet another example, the sports performance monitoring system according to the present invention may, but need not, also include an impact telemetry system which, when housed in the padding assembly, includes any combination of single, double, or triple axis MEMS low-g and high-g accelerometers 44 integrated, housed, or attached to the padding assembly element(s) 32, 34, coupled with a single IC Chip 45 having an electronic circuit 47, a memory 49, a Digital-to-Analog/Analog-to-Digital converters 48, a programmable Digital Signal Processor 50, a wireless transmitter 51, timers, filters, and power source such as a resonator or battery 46 for transmission of the wireless output. A mobile device application 60, or computer, such as a laptop 70, then receives data wirelessly, does the analysis according to a preprogrammed algorithm 61, and displays a magnitude, duration, and direction of the hit 62.

While the present invention has been described in connection with the embodiments as described and illustrated above, it will be appreciated and understood by one of ordinary skill in the art that many modifications may be made in the present invention, without departing from the true spirit and scope of the invention as described and broadly claimed herein.

I claim:

1. An undergarment, comprising:

(a) moisture-wicking elastic fabric base layer, said base layer configured to fit flexibly and snugly against either one of a torso, pelvis and limbs of a person to be protected; and (b) a plurality of padding assembly elements configured in a tiled array, each of said elements of said tiled array, having an inner polymer cushion including an interior surface attached to an outer surface of said base layer and a rigid outer shell directly attached to an outer surface of said cushion, and wherein said plurality of padding assembly elements being attached to said base layer so that said tiled array includes a plurality of outer shell facets being capable of flexible interposition on a dynamic X, Y and Z axes of rotation to dynamically conform said tiled array to form a three dimensional contour being consistent with an exterior anatomical feature of said person while said person is in motion.

2. The undergarment according to claim 1, wherein said elastic base layer comprises a chemically treated microfiber.

3. The undergarment according to claim 1, wherein said polymer cushion comprises a compression molded foam selected from a group consisting of Polyurethane, Polyethylene and Ethylene-Vinyl Acetate.

4. The undergarment according to claim 1, wherein said outer shell is a carbon fiber composite.

5. The undergarment according to claim 1, further comprising an outer fabric layer covering said outer shells of said plurality of said padding assembly elements, wherein said outer layer includes a peripheral margin attached to said base layer.

6. The undergarment according to claim 1, wherein at least one of said padding assembly elements includes an impact sensor.

7. The undergarment according to claim 1, wherein at least one of said padding assembly elements further includes a sports performance monitoring system, said system including at least one impact sensor, wherein said impact sensor being a self-powered piezoelectric electromechanical sensor, said self-powered impact sensor powered by a signal from a resonant response to an impact event, said signal being proportional to a magnitude of the impact event, at least one resonator, said resonator being tuned to provide a resonant response within a frequency range corresponding to a predetermined frequency generated by said impact event, an electronic circuit configured to carry said proportional signal away from said self-powered sensor, and an electronic memory configured to capture a value of the signal.

8. The undergarment according to claim 7 wherein said resonator is a cantilever beam resonator including an array of cantilever beams configured in an ascending length.

9. The undergarment according to claim 8 wherein said array of cantilever beams is integral with said outer shell of said padding assembly.

10. The undergarment according to claim 1, wherein at least one of said padding assembly elements further includes a sports performance monitoring system, said system including at least one impact sensor, wherein said impact sensor is configured as a microelectromechanical accelerometer structure, said accelerometer structure adapted to detect acceleration on either one of one, two, or three orthogonal axes of rotation and generate a signal being proportional to a directional magnitude of said impact, a latchable memory, an electronic circuit, a microcontroller, and a programmable digital signal processor.

11. The undergarment according to claim 10, wherein said sports performance monitoring system further comprises an electronic timer adapted to measure a duration of said signal, and said memory is further configured to capture said signal duration.

12. The undergarment according to claim 10, wherein said sports performance monitoring system further comprises an internal power source capable of providing energy to transmit said signal proportional to said magnitude of said impact to an external device.

13. The undergarment according to claim 12, wherein said sports performance monitoring system further comprises a mobile device for indicating said signal proportional to said magnitude of said impact.

14. The undergarment according to claim 13, wherein said mobile device includes an application adapted to display a calculated result as a function of said signal proportional to said magnitude of said impact.

* * * * *